United States Patent [19]

Van Plantinga

[11] 4,309,953

[45] Jan. 12, 1982

[54] CARGO HANDLING SYSTEM FOR A MARINE CARGO VESSEL

[76] Inventor: John R. Van Plantinga, 255 Emerald Bay, Laguna Beach, Calif. 92651

[21] Appl. No.: 111,686

[22] Filed: Jan. 14, 1980

[51] Int. Cl.[3] ..... B63B 27/36

[52] U.S. Cl. ..... 114/72; 414/139

[58] Field of Search ..... 114/72, 259, 260; 414/137, 139, 140

[56] References Cited

U.S. PATENT DOCUMENTS

| | | | |
|---|---|---|---|
| 3,139,197 | 6/1964 | Bylo | 414/137 |
| 3,450,279 | 6/1969 | Yukawa | 414/140 X |
| 3,793,974 | 2/1974 | Bylo | 414/137 X |
| 3,993,012 | 11/1976 | Kirby et al. | 114/260 |
| 4,135,468 | 1/1979 | Kirby et al. | 114/260 |
| 4,147,123 | 4/1979 | Kirby et al. | 114/260 |

*Primary Examiner*—William A. Cuchlinski, Jr.
*Attorney, Agent, or Firm*—Fulwider, Patton, Rieber, Lee & Utecht

[57] ABSTRACT

A cargo handling system for a marine cargo vessel. The system includes a hold unit wherein is floatably disposed a cargo capsule. The cargo capsule has an upper cargo deck, a lower cargo deck, and a floatation-ballast chamber. Water is moved into and out of the hold unit to vertically position the cargo capsule for selectively loading or unloading the cargo decks.

10 Claims, 8 Drawing Figures

FIG. 5
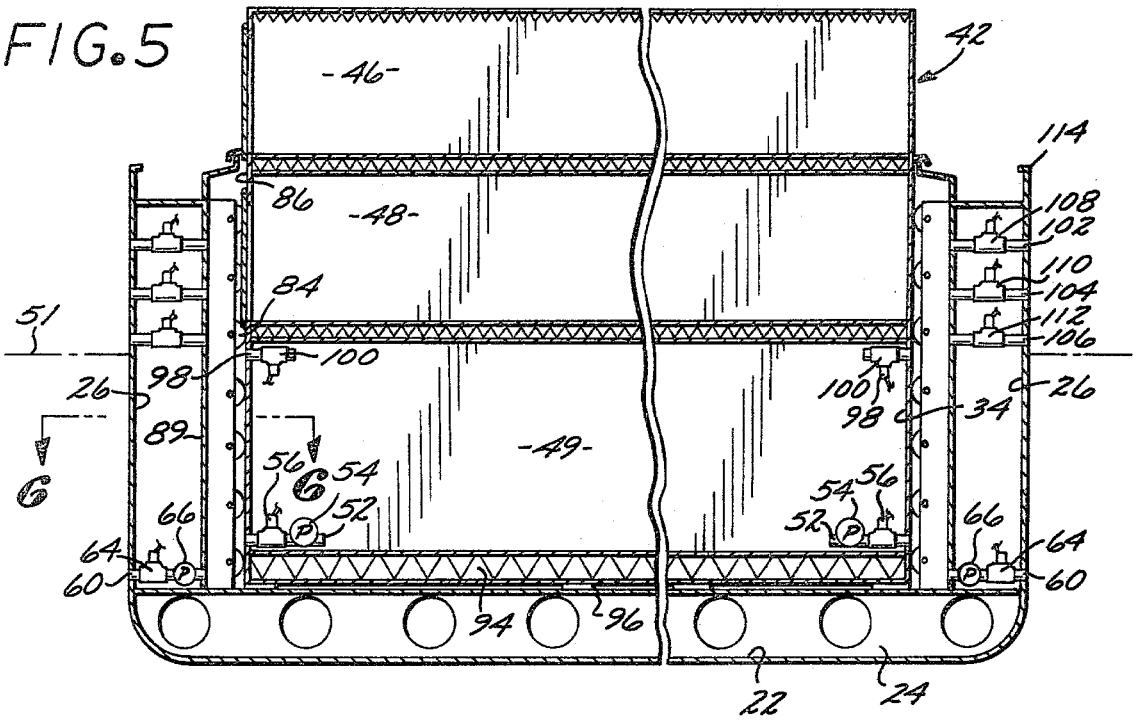
FIG. 6
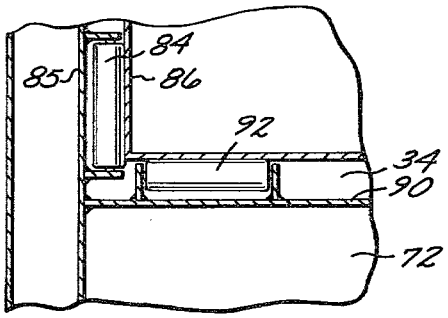
FIG. 8
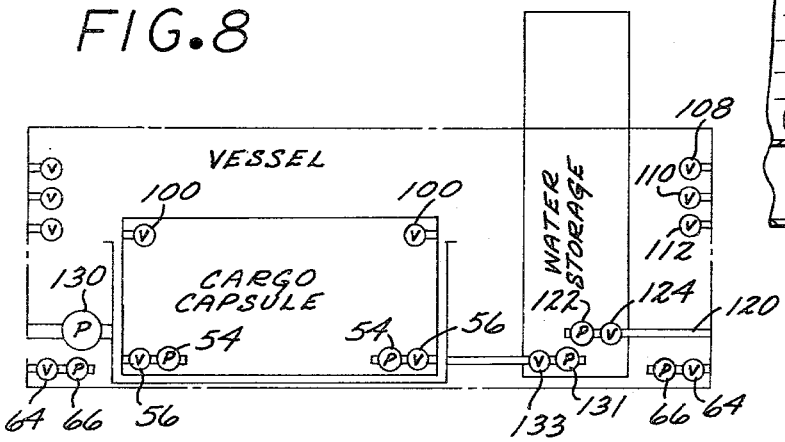
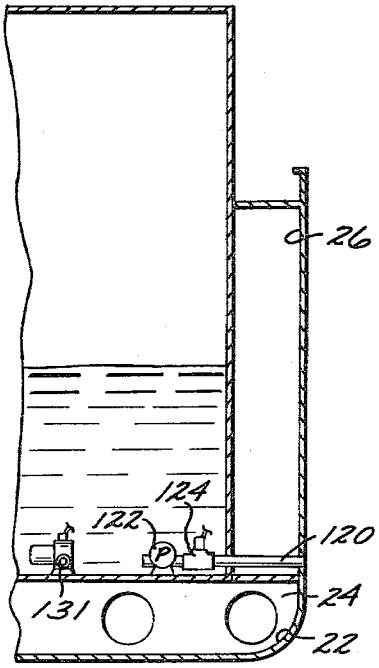
FIG. 7

CARGO HANDLING SYSTEM FOR A MARINE CARGO VESSEL

BACKGROUND OF THE INVENTION

Conventional marine cargo vessels are loaded and unloaded while docked alongside a cargo-handling pier facility. Although pier facilities have become mechanized, the time consumed in vessel loading and unloading is considerable. The amount of time required for loading and unloading activities is determinative of the cost of handling the cargo. Most conventional cargo handling systems utilize large cranes which must either be provided on the cargo-handling pier facility or must be carried by the vessel. Not all cargo-handling pier facilities are provided with the necessary lifting equipment, while the cost of providing a vessel with self-contained lifting equipment is considerable. Additionally, the weight of such lifting equipment reduces the cargo-carrying capacity of the vessel.

SUMMARY OF THE INVENTION

It is a major object of the present invention to provide a cargo-handling system for a marine cargo vessel which eliminates the need of crane or other lifting equipment for loading and unloading cargo.

The cargo-handling system of the present invention is incorporated in a marine cargo vessel having one or more hold units each sealed relative to the vessel's hull. A cargo capsule is floatably disposed within each hold unit. Each cargo capsule includes cargo deck means. Water transfer means moves water into and out of each hold unit, so as to effect vertical movement of each cargo capsule relative to the hull. Ballasting means are provided for adjusting the elevation of the hull relative to its water-line. With this arrangement, the ballasting means is operable to dispose the hull at its cargo load-unload level, and the water-transfer means is operable to selectively position the cargo deck means at a cargo load-unload level relative to a pier.

The cargo-handling system of the present invention greatly reduces the time required by conventional crane systems to load and unload cargo, the costs occasioned by crane breakdowns and the load limits imposed by the load supporting capacity of conventional cranes. Such system also permits multiple unit loading of cargo capsules because the entire side of a cargo capsule may be opened enabling the use of multiple fork lifts to load or unload a single capsule.

It should be particularly noted that the cargo handling system of the present invention is adapted for installation on existing obsolete tanker vessels, so as to provide the advantages of such system without necessarily requiring the construction of new vessels.

DESCRIPTION OF THE DRAWINGS

FIG. 5 is a vertical sectional view taken in further enlarged scale along line 5—5 of FIG. 4;

FIG. 6 is a fragmentary horizontal sectional view taken along line 6—6 of FIG. 5;

FIG. 7 is a broken vertical sectional view taken in enlarged scale along line 7—7 of FIG. 4; and FIG. 8 is a diagrametric view showing the inter-relationship of various elements of said cargo handling system.

DESCRIPTION OF THE PREFERRED EMBODIMENT

Figure 1:
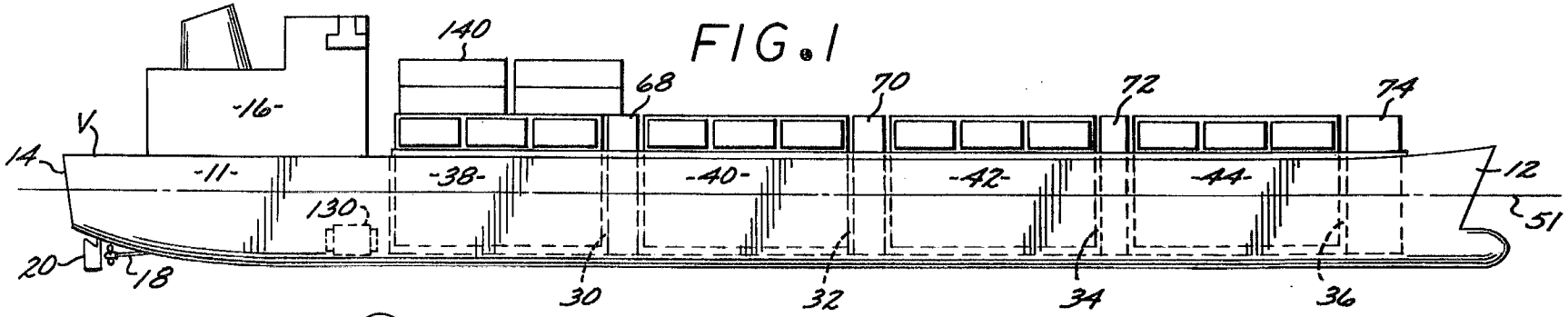
FIG. 1 is a side elevational view of a marine cargo vessel provided with a cargo handling system embodying the present invention.

Referring to the drawings, there is shown a marine cargo vessel V embodying a cargo handling system of the present invention. Vessel V includes a hull 11 having a bow end 12 and a stern end 14. The hull includes superstructure 16 providing a pilot house, crew quarters, galley and the like. It should be understood that the vessel is provided with conventional propulsion machinery including screw means 18 disposed forwardly of rudder means 20. Hull 11 includes ballast tanks 22 disposed within a double bottom 24 and trim tanks 26 along its sides. The hull 11 is formed along its length with a plurality of hold units, generally designated 30, 32, 34 and 36. Each hold unit is provided with floatable cargo capsules, generally designated 38, 40, 42 and 44. The capsules each include an upper cargo deck, generally designated 46 and a lower cargo deck, generally designated 48, and a floatation chamber 49 positioned below lower cargo deck 48. Water is transferred into and out of the hold units to selectively position the upper and lower cargo decks at a cargo load-unload level relative to the cargo handling pier 50 shown in FIGS. 2 and 3. Vessel V has a normal waterline level 51.

More particularly, each hold unit is sealed relative to the other portions of the hull. Water transfer means are provided to move water into and out of each hold unit and floatation-ballast chamber of the cargo capsules, so as to effect vertical movement of the cargo capsule disposed within the individual hold units. The water transfer means will include suitable piping, valves and power operated pumps of conventional construction. By way of representation there are shown in FIGS. 5 and 7, pipes 52 provided with motor driven pumps 54 and electrically actuated valves 56 arranged at each lower side of floatation-ballast chamber 49 of cargo capsule 42. The pipes 52 will be in communication with the lower interior of hull 11. Water will be admitted to the lower interior of the hull by means of lower side pipes 60 that extend through the hull sides and are provided with electrically actuated valves 64 and power-operated pumps 66. The interior of the hold units will also be connected by a piping to a plurality of vertically extending storage tanks 68, 70, 72 and 74, formed along the length of hull 11 by suitable piping power driven pumps and valving.

Each cargo capsule is of generally similar construction. The upper and lower cargo decks will be provided with side access ports 80 closed by a vertically movable hatch 82 as shown particularly in FIG. 4. As shown in FIGS. 5 and 6, a plurality of longitudinally extending horizontal rollers 84 will be provided on the interior wall 85 of the hull 11 to engage the corner sidewalls 86 of the cargo capsules. The transversely extending bulkheads 90 interposed between the hold units and storage tanks support an additional plurality of transversely aligned, vertically spaced, rollers 92 that engage the corners of the endwalls 93 of the cargo capsules adjacent rollers 84. The rollers 84 and 92 prevent jamming of the cargo capsules, particularly under conditions where one side of the capsule carries a heavier load than the other side. As indicated in FIG. 5, each cargo capsule is provided with a double bottom wall 94 that grounds upon top wall 96 of the hull's double bottom. FIG. 5 also discloses vent pipes 98 provided with electrically actuated valves 100 disposed at the upper side portions of each of the floatation chambers 49. Also shown in this figure are three vertically spaced drain pipes 102, 104, and 106 provided with electrically actuated valves 108, 110 and 112 that extend through the sides of hull 11 below the gunwale portion 114 thereof.

Figure 4:
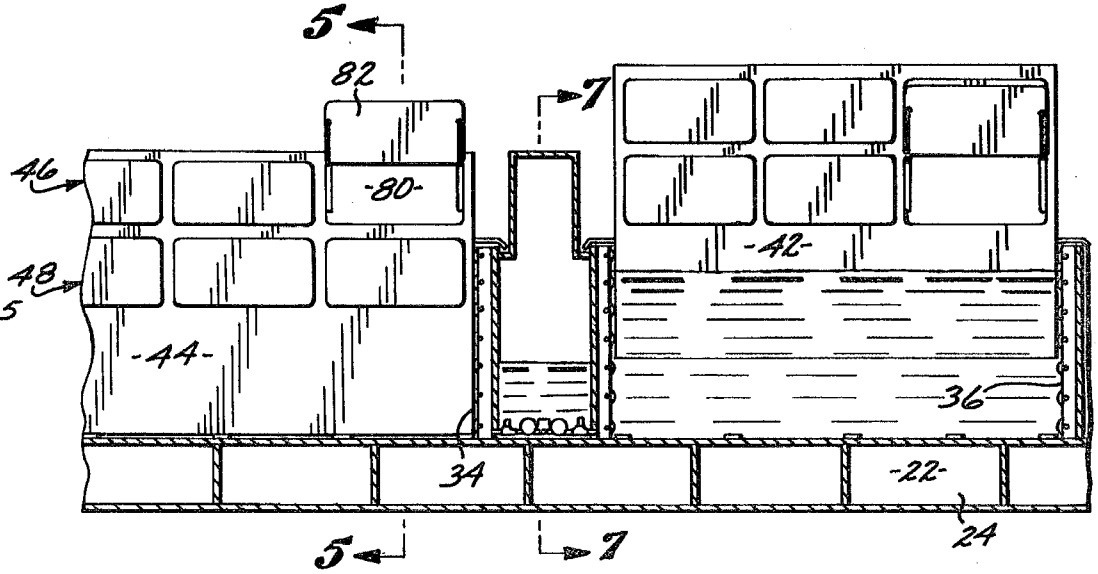
FIG. 4 is a fragmentary side view in enlarged scale showing the hull of said marine cargo vessel with said hull broken away to disclose the interior thereof.

The construction of storage tanks 68, 70, 72 and 74 is shown particularly in FIGS. 4 and 7. Such tanks extend upwardly from the hull's double bottom 24 to an elevation above gunwale 114. Water is admitted to and removed from the lower part of such tanks by means of pipes 120 that extend through the sides of hull 11, such pipes being provided with a lower power-operated pump 122 and an electrically actuated valve 124. Suitable vents (not shown) will also be provided for the storage tanks.

Vessel V carries one or more conventional ship's pumps 130 aft of the cargo area. Such pump or pumps 130 are connected by suitable piping to the interior of each of the hold units and storage tanks.

In the operation of the aforedescribed cargo handling system, one or more lower cargo decks 48 will first be loaded with cargo. This is accomplished by positioning the vessel V alongside pier 50 at the vessel's normal cargo load-unload level 115 shown in FIGS. 2 and 3. At such level gunwale 114 is adjacent the top surface of pier 50. It may be necessary to adjust the waterline level of the hull by ballasting in order to effect such positioning. The lower cargo deck 48 must also be disposed at its cargo load-unload level relative to pier 50 whereby its conventional loading shelf 132 is properly positioned for receiving cargo from the pier, as by means of fork lifts (not shown). Such positioning of the lower cargo deck is accomplished by flooding the hold unit of the respective cargo capsule so as to float such cargo capsule upwardly to its position of FIG. 3. At this time the floatation-ballast chamber 49 of such cargo capsule is substantially empty. As cargo is loaded onto the lower cargo deck or decks it may be necessary to admit additional water to the subject hold units to prevent said cargo capsule from sinking. When the lower cargo decks have been loaded, their hatches 82 are closed.

Figure 2:
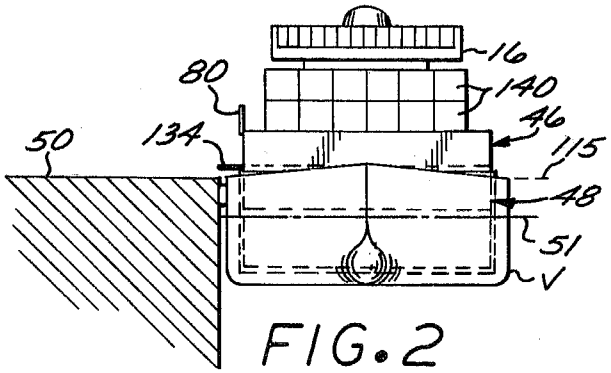
FIG. 2 is a front view of said marine cargo vessel disposed alongside a pier at the vessel's load-unload level for loading or unloading an upper cargo deck.

Water is then removed from the hold units whereby the cargo capsules will settle into a lowermost position grounded on the hull's double bottom 24, i.e. the position shown in FIGS. 2 and 5. The upper cargo decks 46 can now be loaded in the same fashion as were the lower cargo decks by means of shelf 134. Thereafter, the hatches 82 of the upper cargo decks will be closed. With the cargo capsules loaded and grounded, containers 140 (or other deck cargo) may be secured above the cargo capsules. The tops of storage tanks 68, 70, 72 and 74 may provide support for such deck cargo. It should also be noted that such storage tanks may carry a liquid pay load which would generally be unloaded before the cargo capsules. Also the cargo capsule floatation-ballast chamber can carry liquid payload. Alternatively, all these tanks may carry ballast as required to maintain vessel stability.

The vessel's conventional ballasting means may be utilized to obtain proper waterline trim while the vessel is underway. Should additional ballast be required, however, water may be admitted to the floatation chambers 49.

To unload the cargo capsules, vessel V will be moored alongside pier 50 at its proper cargo load-unload level shown in FIG. 2. Ballasting may be required to adjust the vessel's waterline level 51, as during normal cargo handling operations. The upper cargo decks 46 will then automatically be disposed at their proper cargo load-unload level and their cargos will be unloaded. Thereafter, any water contained within the floatation-ballast chambers will be removed therefrom. Water is then admitted to the hold units so as to float the cargo capsules upwardly until lower cargo decks 48 are positioned at their cargo load-unload level of FIG. 3. The lower cargo decks are then unloaded.

Figure 3:
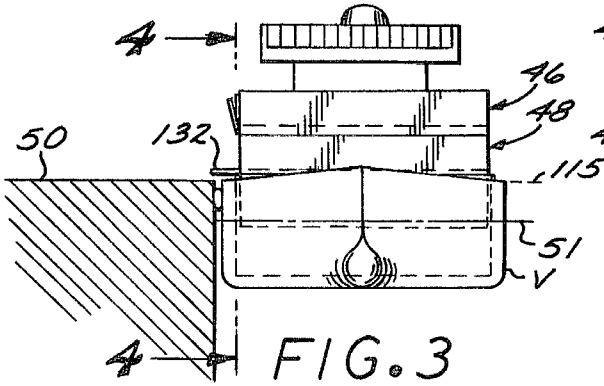
FIG. 3 is a view similar to FIG. 2 but showing the parts of said cargo handling system disposed in a second position for loading or unloading a lower cargo deck.

If should be understood that the volume, and hence buoyancy of the floatation-ballast chambers is dependent upon the anticipated weight of the cargo load-unload level of FIG. 3. The less the cargo weight to be lifted, the smaller the volume of the floatation-ballast chamber.

If the storage tanks 68, 70, 72 and 74 have been filled with a liquid cargo, such cargo is removed before the cargo capsules are unloaded. The storage tanks may then be filled with water by their own small motor-driven pumps 122 and/or the ship's pump 130 by piping (not shown). The head of water in the storage tanks may then be selectively directed into any of the hold units so as to assist in floating the cargo capsules to their uppermost position. Pumps 131 and valves 133 positioned in the storage tanks may also be utilized for this purpose. Preferably, the storage tanks will be so interconnected that if some of the pumps 122 thereof break down, the pumps of the other storage tanks may be substituted for the inoperative pumps. Referring to FIG. 5, the provision of the three drain pipes 102, 104 and 106 facilitate draining of the hull 11 to predetermined levels without requiring all of the water to flow through pump means.

It should be noted that the cargo capsules may be provided with a single cargo deck rather than upper and lower cargo decks.

Various other modifications and changes may be made with respect to the foregoing description without departing from the scope of the present invention.

I claim:

1. A marine cargo vessel having a hull provided with a normal waterline and a normal cargo load-unload level, said vessel comprising:

a hold unit in said hull that is sealed relative to said hull;

a cargo capsule floatably disposed within said hold unit having cargo deck means, formed with side-opening cargo hatch means, and a floatation-ballast chamber below said cargo deck means;

first water-transfer means to move water into and out of said hold unit so as to effect vertical movement of said cargo capsule relative to said hull;

second water transfer means to move water into and out of said floatation-ballast chamber relative to said hold unit; and ballasting means for adjusting the elevation of said hull relative to said waterline, with said ballasting means being operable to dispose said hull at its cargo load-unload level.

2. A marine cargo vessel as set forth in claim 1, wherein said cargo deck means includes an upper cargo deck and a lower cargo deck disposed therebelow.

3. A marine cargo vessel as set forth in claim 2, wherein said water transfer means include pumps, piping and valves.

4. A marine cargo vessel as set forth in claim 2, wherein said hull is provided with a plurality of said hold units, cargo capsules and water-transfer means, said hull also being formed with storage tank means and third water-transfer means between said storage tank means and said hold units.

5. A marine cargo vessel as set forth in claim 2, wherein roller means are interposed between said hold unit and said cargo capsule.

6. A marine cargo vessel as set forth in claim 1, wherein said water transfer means include pumps, piping and valves.

7. A marine cargo vessel as set forth in claim 1, wherein said hull is provided with a plurality of said hold units, cargo capsules and water-transfer means, said hull also being formed with storage tank means and third water-transfer means between said storage tank means and said hold units.

8. A marine cargo vessel as set forth in claim 7, wherein said water transfer means include pumps, piping and valves.

9. A marine cargo vessel as set forth in claim 8, wherein roller means are interposed between each of said hold units and its respective cargo capsule.

10. A marine cargo vessel as set forth in claim 1, wherein roller means are interposed between said hold unit and said cargo capsule.

* * * * *